United States Patent [19]

Catallo

[11] Patent Number: 4,959,893

[45] Date of Patent: Oct. 2, 1990

[54] APPARATUS FOR A PRESHRINKING ARRANGEMENT TO HEAT THE FABRIC AT A CONTROLLED TEMPERATURE

[76] Inventor: Frank Catallo, 84 Wheatly Rd., Old Westbury, N.Y. 11568

[21] Appl. No.: 418,179

[22] Filed: Oct. 6, 1989

[51] Int. Cl.[5] ..... D06C 21/00; F28D 11/02

[52] U.S. Cl. ..... 26/18.6; 165/90

[58] Field of Search ..... 29/124, 125; 165/89, 165/90; 26/18.5, 18.6

[56] References Cited

U.S. PATENT DOCUMENTS

| | | | |
|---|---|---|---|
| 1,919,416 | 7/1933 | Cram | 165/90 X |
| 2,494,808 | 1/1950 | Haeberlin | 26/18.5 |
| 3,866,277 | 2/1975 | Hoiyo | 26/18.6 |
| 4,485,573 | 12/1984 | Kamberg | 165/90 X |
| 4,689,862 | 9/1987 | Catallo | 26/18.6 |
| 4,734,229 | 3/1988 | Johnson et al. | 165/2 X |

FOREIGN PATENT DOCUMENTS

| | | | |
|---|---|---|---|
| 3027686 | 9/1982 | Fed. Rep. of Germany | 26/18.6 |

*Primary Examiner*—Werner H. Schroeder
*Assistant Examiner*—Bradley Kurtz DeSandro
*Attorney, Agent, or Firm*—Leo Fornero

[57] ABSTRACT

The disclosure is directed to an apparatus for preshrinking fabric which in various forms moves a web of shrinkable material through a nip like configuration and usually by compression reduces the webs potential shrinkage a predetermined amount.

More particularly there is shown a system for heating fabric at a controlled temperature by utilizing the normally associated steam heat source of the apparatus which usually functions to dampen the fabric prior to treatment as provided for in the present invention on the one hand along with a heated oil supply which is disposed in a chamber of the shrinking unit to thusly provide an additional heat source for the fabric to facilitate shrinkage or other treatment of the fabric.

8 Claims, 3 Drawing Sheets

APPARATUS FOR A PRESHRINKING ARRANGEMENT TO HEAT THE FABRIC AT A CONTROLLED TEMPERATURE

BACKGROUND OF THE INVENTION

The invention relates to an apparatus for preshrinking a web material such as woven or knitted fabric. Such apparatus normally is provided with a pressurized steam source which is generally used to dampen the fabric as a preconditioning step prior to treating the web as desired.

A number of different machines have been proposed to effect shrinkage of the fabric. Some of these machines utilize two spaced rolls rotating in opposite directions at different speeds forming a nip into which a fabric is fed. An implement is disposed in the nip area and referred to as a doctor blade and acts to force the fabric into the textured or high friction surface of one of the rolls operating at a faster speed whereby a short columnar length of fabric between the doctor blade and nip is compressed.

Other machinery has also been used to preshrink fabric for example, a shoe has taken the place of the doctor blade. Preshrinking of fabric has been achieved by using a pair of endless belts which are spaced from each other and move in the same linear direction. The belts used are such that the linear speed of the surface of the belt may be changed by varying its thickness in conjunction with creating a curvature of the belt as it moves from the curved surface to the flat surface with the result that when web material fed between the belts is to be longitudinally shrunk the spacing between the belts is increased by decreasing the belt thickness with the result that the surface speed of the belt is being reduced so as to act as a retarding force on the fabric. The curved surface of the belt also cooperates to amplify the shrinkage effect as will be understood by one skilled in the art. Another arrangement for shrinking of fabric comprises a two roll arrangement forming a stuffing chamber in which fabric is shrunk and such arrangement may include a blade member to facilitate the shrinking procedure. Other preshrinking equipment is known which may be fitted with my invention as will be understood from the description which follows.

In most of these arrangements a heat source is provided to condition the fabric prior to the treatment contemplated so as to optimize such treatment.

It is also especially desirable to heat the fabric during treatment in a uniform and controlled fashion and a variety of arrangements exist which can accomplish this beneficial heating of the fabric.

There are steam filled rolls, oil filled rolls and rolls heated with other sources. None known to me are entirely satisfactory since it is not possible without substantial expense to control the uniformity of the heat. This is sometimes accomplished through the use of complex and expensive equipment. The use of added equipment has the obvious drawback of requiring additional space and expense.

It is therefore an object of this invention to provide a preshrinking apparatus already including a source of heat with an apparatus utilizing the source of heat such as steam to heat the fabric in a controlled and uniform fashion.

Another object of this invention is to provide an apparatus for applying heat to a fabric at a controlled temperature which is easy to manufacture and efficient in its operation and economical to make.

For a more complete understanding of the invention and other features and advantages thereof reference should be made to the following detailed description of a preferred embodiment and to the accompanying drawings.

BRIEF DESCRIPTION OF THE DRAWINGS

In the drawings wherein like reference numerals denote corresponding parts through the several views.

GENERAL DESCRIPTION OF THE INVENTION

Broadly in accordance with the present invention an apparatus is provided whereby the normally associated steam source is utilized in a new and efficient manner to heat a fluid such as oil to a predetermined temperature so that the fluid operates to heat the web being treated to a predetermined controlled temperature which has substantial uniformity.

Figure 1:
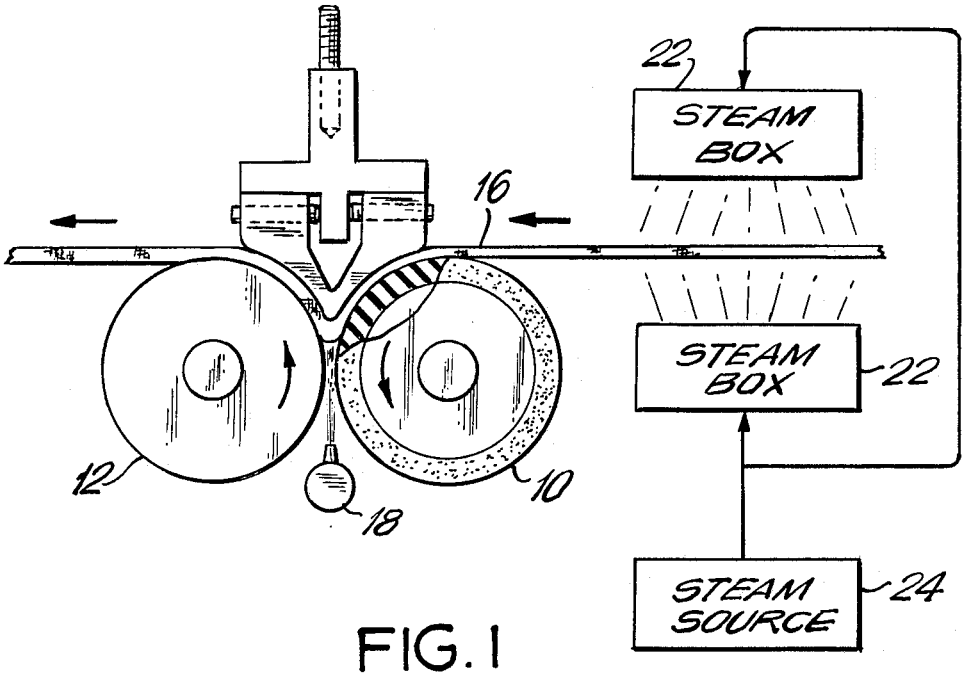
FIG. 1 is a diagrammatical cross sectional view of one type of preshrinking apparatus wherein the invention contemplated herein may be utilized.
Figure 2:
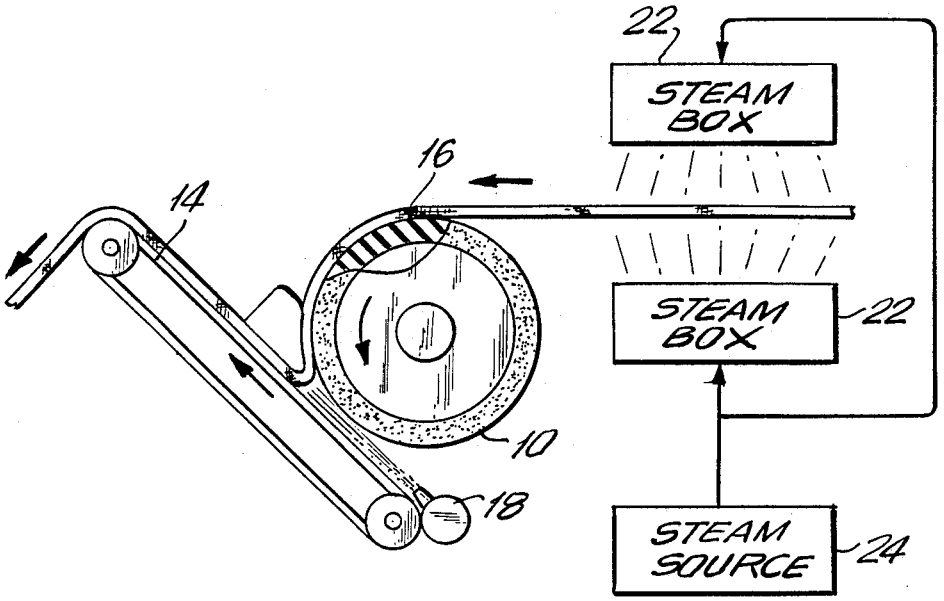
FIG. 2 is a diagrammatical cross sectional view showing another type of preshrinking apparatus wherein the invention contemplated herein may be utilized.

Such apparatus including a steam source is shown diagrammatically in FIG. 1 and FIG. 2 and it will be understood by one skilled in this art that the roll or member 10 is journaled and supported in well known structures not shown. Rotation as shown by the arrows in FIG. 1 and FIG. 2 is provided for. In FIG. 2 a moving belt 14 takes the place of roll 12 to cooperate with the roll 10 to shrink the web 16 as desired. This web travels in the direction of the arrow in FIG. 2. A steam jet 18 may be provided to treat as by dampening the fabric in the vicinity of the nip as will be clear to a technical individual versed in this art. Also a steam spray 22 receiving a source of steam from a pressure chamber 24 may also be used to dampen the fabric as shown in FIG. 1 and FIG. 2.

Figure 3:
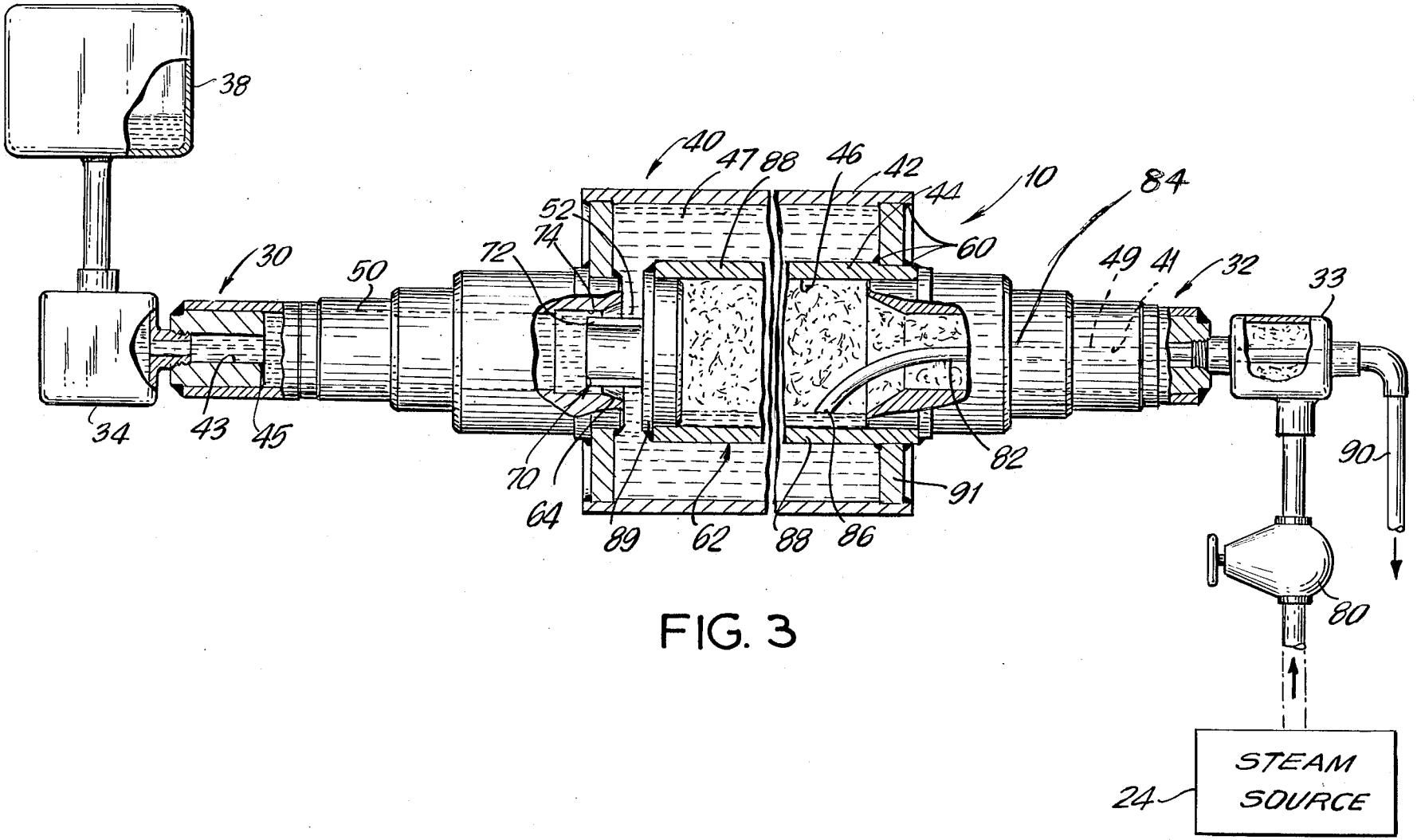
FIG. 3 is a partial cross sectional view of a roll or shrinking member including the means for controlled heating of the fabric contemplated by this invention.
Figure 4:
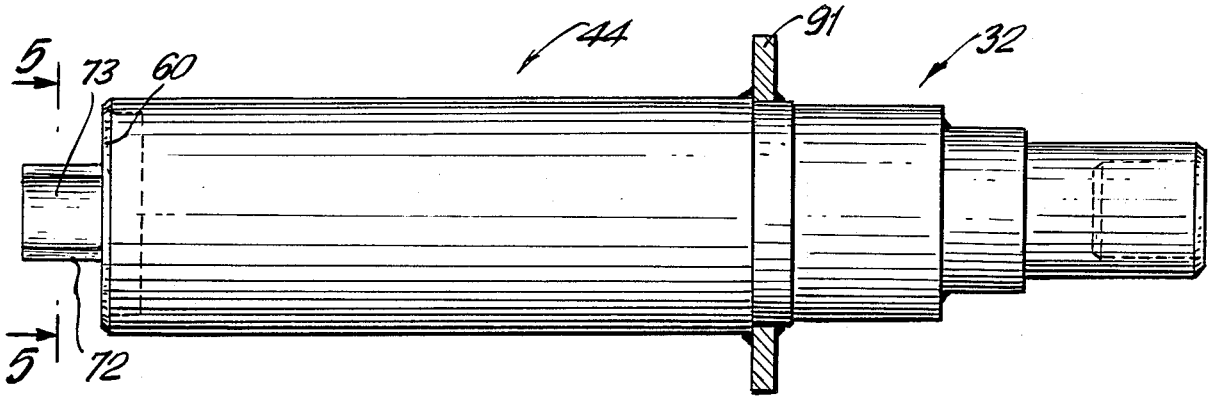
FIG. 4 is a side view of the roll or member shown in FIG. 3 hereof.

As contemplated herein the steam source 24 also shown diagrammatically in FIG. 3 is used as mentioned herein to heat a fluid which may be oil to controllably heat to a predetermined temperature the fabric or web 16.

Roll 10 shown in partial section in FIG. 3 is journaled as indicated hereinabove in bearing members on supports at each end thereof 30 and 32. At each of the ends of the roll 10 are mounted a rotary steam joint 33 and a rotary oil joint 34. The joint 33 provides for the leak free introduction of steam from source 24 to the member or roll 10 and the rotary oil joint 34 provides the same facility for the oil from source 38 to the roll or member 10 as will be described in detail hereinafter.

Roll 10 as will be clear in an analysis of FIG. 1 operates as will be understood by one skilled in this art to cooperate with the other elements of the shrinking unit to compress the fabric to achieve a predetermined degree of preshrinkage. It also will be clear that the fabric 16 runs or travels over roll 10 as shown in FIG. 1 or FIG. 2.

Now referring particularly to roll 10 as shown in FIG. 3 a roll having various different external dimensions along its length is shown and comprises an outer member 40 having a cylindrical configuration and with a textured surface 42. An internal member 44 is disposed within the outer member 40 and provides a first internal chamber 46 and a second external chamber 47. The internal member 44 is disposed longitudinally within the roll 10 and comprises a cylinder 88 mounted on a circular plate 91 which is welded to the inner portion of the roll 10 as is shown in FIG. 3 of the drawings. The roll 10 as will be clear to one skilled in the art may be forged or machined or may be a combination of these techniques and include a bore 43 running centrally through its length. At one end 30 of the roll the bore 43 provides a channel 45 for the oil and at the other end 32 the bore designated 41 provides a channel 49 for the steam from source 24. The chamber 47 is supplied with oil flowing through sealed bore 43 and has a tube like configuration and shown in FIG. 3. At the other end 32 of roll 10 a similar bore 41 having a channel 49 and of tube like form is constructed to provide flow of steam into the chamber 46. The internal longitudinal member 44 is permitted to float at end 52 FIG. 3 but is welded at various locations at end 32 in order to preclude the passage of steam into chamber 47. In this connection see welds 60. The internal element 44 at the end 52 is sealed by inserting plug 89 into cylinder member 62. At the end of plug 89 means are mounted and designated 64 to permit movement of the internal element 44 upon expansion or contraction thereof caused by temperature changes.

Figure 5:
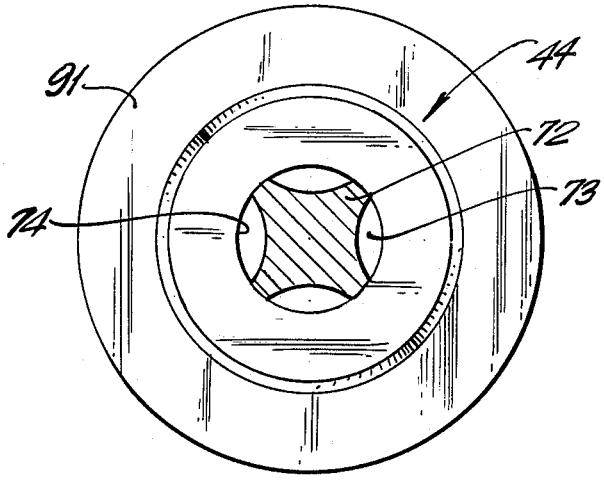
FIG. 5 is an end view taken on lines 5—5 of FIG. 4 in partial section.

The means 64 comprise a male member 70 ; spider 72 having cut outs 73 best shown in FIG. 5 to permit flow of oil or fluid into external chamber 47. The male member is arranged to slide in bore 74 formed internally at end 30 of the roll 10. In this fashion expansion and contraction are provided for in the internal element 44 on changes in the temperature in the internal chamber 46. The temperature of the steam may be varied by adjusting a steam regulator 80.

As will be understood condensate normally builds up in chamber 46 and if allowed to remain and during operation of the apparatus could create additional uneven heat distortion and cause damage. To overcome this problem a tube 82 is fixed to internal bore 84 and the tip of the tube 86 is disposed in close proximity with the inner wall 88 of the first chamber 46. In this fashion as will be clear to one skilled in the art condensate will be discharged through the siphon tube 82 and out the condensate discharge pipe 90.

In operation the fabric may now be heated through the use of the associated steam service supplied to the first internal chamber 46 which in turn transfers heat to the oil, a more stable heating medium, which in turn heats through the cylinder wall of the roll the fabric to a controlled and desired temperature.

It should be understood of course that the specific forms of the invention herein illustrated and described are intended representative only as certain changes may be made in the invention without departing from the clear teachings of the disclosure. Accordingly, reference should be made to the following appended claims determining the full scope of the invention.

I claim:

1. In an apparatus for preshrinking fabric comprising, at least one roll member cooperating with another member to shrink fabric, said apparatus including a steam source arranged to dampen said fabric, said steam source also arranged to supply heat to one of said members, said fabric to move on said apparatus and in abutment with said one of said members and said one of said members including an internally disposed member arranged therein to provide a first internal and second external chamber relative said first internal chamber, said steam source being connected to said first chamber, and said one of said members including means to slidably and sealably separate said first chamber from said second chamber, means connected to said one of said members to permit movement of said internally disposed member relative said one of said members when heat in said first chamber causes distortion of said internally disposed member, an oil supply connected to said second chamber whereby said oil is heated by the steam so that said fabric in abutment with said one of said members is heated to a predetermined temperature.

2. The apparatus according to claim 1 wherein the means connected to said one of said members to permit movement of the internally disposed member is mounted on said internally disposed member and comprises a longitudinally movable member sealably disposed at one end of said internally disposed member to form a closed end of said first internal chamber and a cooperating member also disposed on said one of said members in sealable sliding relation with said longitudinally movable member to form the other end of said first chamber and means associated with said longitudinally movable member at the other end thereof and disposed relative said cooperating member to allow for the passage of oil from said oil source into said second external chamber.

3. The apparatus according to claim 2 wherein a siphon member is inserted in one of said roll members and relative said first chamber to provide for the passage of condensate out said first chamber.

4. In an apparatus for preshrinking fabric comprising, a first roll member cooperating with a second roll member to shrink fabric, said apparatus including a steam source arranged to dampen said fabric, said steam source also arranged to supply heat to one of said roll members, said fabric to move on said apparatus and in abutment with one of said roll members and said one of said roll members having an internally disposed member arranged therein to provide a first internal and second external chamber relative said first chamber, said steam source being connected to said first chamber, and said one of said roll members including means to slidably and sealably separate said first chamber from said second chamber, means connected to said one of said roll members to permit movement of the internally disposed member relative said one of said roll members when heat in said first chamber causes distortion of said internally disposed member, an oil supply connected to said second chamber whereby oil is heated by the steam so that fabric in abutment with said one of said roll members is heated to a predetermined temperature.

5. The apparatus according to claim 4 wherein the means connected to said one of said members to permit movement of the internally disposed member is mounted on said internally disposed member and comprises a longitudinally movable member sealably disposed at one end of said one of said internally disposed members to form a closed end of said first internal chamber and a cooperating member also disposed on said one of said members in sealable sliding relation with said longitudinally movable member to form the other end of said first chamber and means associated with said longitudinally movable member at the other end thereof and disposed relative said cooperating member to allow for the passage of oil from said oil source into said second external chamber.

6. In an apparatus for preshrinking fabric comprising, a first roll member having a rubber covered outer surface, a second roll member cooperating with the first roll member to form a stuffing chamber, means disposed in the stuffing chamber to cooperate with both of said rolls for preshrinking said fabric, said apparatus including a steam source arranged to dampen said fabric, said steam source also arranged to supply heat to one of said roll members, said fabric to move on said apparatus and in abutment with one of said roll members and said one of said roll members including an internally disposed member arranged therein to provide a first internal and a second external chamber relative said first chamber, said steam source being connected to said first internal chamber, and said one of said roll members including means to slidably and sealably separate said first chamber from said second chamber, means connected to said one of said roll members to permit movement of said internally disposed member relative said one of said roll members when heat in said first chamber causes distortion of said internally disposed member, an oil supply connected to said second chamber whereby oil being heated by said steam heats said fabric in abutment with said roll member to a predetermined temperature.

7. The apparatus according to claim 6 wherein the means connected to said one of said members to permit movement of the internally disposed member is mounted on said internally disposed member and comprises a longitudinally movable member sealably disposed at one end of said one of said internally disposed members to form a closed end of said firSt internal chamber and a cooperating member also disposed on said one of said members in sealable sliding relation with said longitudinally movable member to form the other end of said first chamber and means associated with said longitudinally movable member at the other end thereof and disposed relative said cooperating member to allow for the passage of oil from said oil source into said second external chamber.

8. The apparatus according to claim 7 wherein a siphon member is inserted in one of said roll members and relative said first chamber to provide for the passage of condensate out said first chamber.

* * * * *